United States Patent [19]

Aser

[11] Patent Number: 4,610,526

[45] Date of Patent: Sep. 9, 1986

[54] REPRODUCING MACHINE

[75] Inventor: Gilbert A. Aser, Rochester, N.Y.

[73] Assignee: Xerox Corporation, Stamford, Conn.

[21] Appl. No.: 751,478

[22] Filed: Jul. 3, 1985

Related U.S. Application Data

[63] Continuation of Ser. No. 126,586, Mar. 3, 1980, abandoned.

[51] Int. Cl.[4] ..... G03G 15/14; G03G 15/22

[52] U.S. Cl. ..... 355/3 BE; 355/3 R; 355/16

[58] Field of Search ..... 355/1, 3 R, 3 BE, 8, 355/16

[56] References Cited

U.S. PATENT DOCUMENTS

| | | | |
|---|---|---|---|
| 3,574,455 | 4/1971 | Mix et al. | 355/3 R |
| 3,771,866 | 11/1973 | Ogawa | 355/16 X |
| 3,843,252 | 10/1974 | Tanaka et al. | 355/16 |
| 3,867,027 | 2/1975 | Weigl | 355/16 X |
| 4,068,936 | 1/1978 | Kushima et al. | 355/1 |

*Primary Examiner*—Fred L. Braun

[57] ABSTRACT

An electrophotographic reproducing machine having a photoconductive belt, a fixed platen for supporting an original document, and a translatable carriage having, fixedly mounted thereon in fixed relation to each other, a corona generating device for charging the belt, a document scanner for scanning the document on the platen and producing a latent image thereof on the belt, a transfer device for transferring the latent image from the belt to a dielectric sheet, and a roller about which the belt is entrained. One end of the belt is held, so that, as the carriage is translated, the belt is charged and the document is scanned and a latent image is formed onto the stationarily held portion of the precharged belt near the carriage roller. The other end of the belt is attached to a takeup roll which keeps the belt taut around the carriage roller as the carriage moves in the scanning direction. The portion of the belt with the latent image increments travels around the roller and past the transfer device, while the unimaged portion of the belt remains stationary. A dielectric sheet is fed to the transfer device in register with the latent image on the belt whereat the latent image is transferred thereto. When the document has been fully scanned and imaged on the belt, the carriage returns to scan the same or another document. During the return, the takeup roll dispenses the belt while maintaining it taut about the carriage roller.

6 Claims, 3 Drawing Figures

REPRODUCING MACHINE

This is a continuation of application Ser. No. 126,586 filed Mar. 3, 1980, now abandoned.

This invention relates generally to a reproducing machine, and more particularly concerns an electrophotographic printing machine having a stationary photoconductive member and a stationary original document.

The process of electrostatographic printing requires the formation and utilization of an electrostatic latent image for the purpose of recording and reproducing patterns in viewable form. Electrostatographic printing includes electrophotographic printing and electrographic printing. In electrophotographic printing, electromagnetic radiation is used to form an electrostatic latent image on a photoconductive member. An electrographic printing machine employs an insulating medium to form, without the aid of electromagnetic radiation, an electrostatic latent image. Generally, the process of electrophotographic printing includes charging a photoconductive member to a substantially uniform potential to sensitize the surface thereof. The charged portion of the photoconductive surface is exposed to a light image of an original document being reproduced. This records an electrostatic latent image on the photoconductive member corresponding to the informational areas contained within the original document being reproduced. After the electrostatic latent image is recorded on the photoconductive member, the latent image is developed by bringing particles of a developer mix into contact therewith. The developer mix particles are attracted to the latent image forming a particle image on the photoconductive member. The particle image is then transferred from the photoconductive member to a copy sheet. Finally, the copy sheet is heated to permanently affix the particles thereto in image configuration. This general approach was disclosed by Carlson in U.S. Pat. No. 2,297,691 and has been further amplified and described in many related patents in the art.

In electrophotographic printing, the electrostatic latent image comprises electrostatic surface charges. These surface charges may be transferred to or reproduced upon a dielectric surface. The technique for accomplishing charge transfer is referred to as a TESI process, for transfer of electrostatic latent images. Hence, electrostatic latent images may be transferred to another surface prior to development. The material to which the electrostatic latent image is transferred must, of course, be capable of retaining the image, i.e. it must be a good insulator. Thus, electrostatic latent images may be transferred to the dielectric coated paper. The transferred images can be developed by the same methods hereinbefore described for developing the electrostatic latent images recorded on the photoconductive member. However, since the charge on the dielectric surface is not dissipated by exposure to light, it is not necessary to shield the image from light during development. After the electrostatic latent image transferred to the dielectric sheet has been developed, the powder image thereon may be fused thereto forming a finished copy sheet.

Various types of electrostatographic printing machines have hereinbefore been employed to utilize the foregoing processes. The following disclosures appear to be relevant:

U.S. Pat. No. 2,825,814; Patentee: Walkup; Issued: Mar. 4, 1958.

U.S. Pat. No. 2,833,648; Patentee: Walkup; Issued: May 6, 1958.

U.S. Pat. No. 2,937,943; Patentee: Walkup; Issued: May 24, 1960.

U.S. Pat. No. 2,975,052; Patentee: Fotland et al.; Issued: Mar. 14, 1961.

U.S. Pat. No. 2,982,647; Patentee: Carlson et al.; Issued: May 2, 1961.

U.S. Pat. No. 3,574,455; Patentee: Mix, Jr.; Issued: Apr. 13, 1971.

The relevant portions of the foregoing disclosures may be briefly summarized as follows:

The Walkup patents disclose a photosensitive plate closely spaced to an electrode with an insulating web passing therebetween. Voltage is induced between the plate and electrode to cause the electrical charge pattern recorded on the plate to migrate to the web. The web is developed and the resultant powder image fused thereto so as to form a copy of the original document.

Fotland et al. describes the formation of an electrostatic latent image on a photosensitive element. The photosensitive element is brought into contact with a plate consisting of an electrically insulating material and an electrically conductive material. Electrical contact is established between the conductive layer of the photosensitive element and the conductive material of the plate. As a result, the latent image is transferred to the insulating material of the plate which is developed into a visible image.

Carlson et al. teaches the transfer of an electrostatic latent image which has been previously formed on a first insulating surface to a second insulating surface in contact therewith by producing an intense electrical field between the surface and subsequently separating the surfaces.

Mix, Jr. describes a photoconductive drum moving in a planetary motion so that a point on the drum's surface has zero velocity when adjacent to a particular functional station. This permits incremental printing upon the paper. This movement of the drum permits the paper to be moved freely between printing stations.

In accordance with the features of the present invention, there is provided a reproducing machine including means for supporting substantially stationarily an original document being reproduced and a photoconductive member. Means to record the latent image on the photoconductive member. Means are provided for translating the photoconductive member with the portion of the photoconductive member in communication with the recording means being substantially stationary relative to the original document being reproduced.

Other features of the present invention will become apparent as the following description proceeds and upon reference to the drawings, in which.

Figure 1:
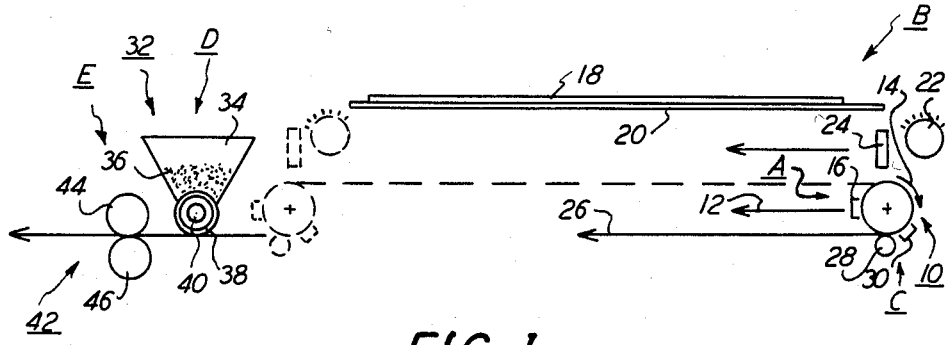
FIG. 1 illustrates a schematic elevational view of one embodiment of the reproducing machine of the present invention employing a photoconductive drum.

While the present invention will hereinafter be described in connection with various embodiment thereof, it will be understood that it is not intended to limit the invention to these embodiments. On the contrary, it is intended to cover all alternatives, modifications and equivalents as may be included within the spirit and scope of the invention as defined by the appended claims.

For a general understanding of the reproducing machine of the present invention, reference is made to the drawings. In the drawings, like reference numerals have been used throughout to designate identical elements. The drawings depict various embodiments of illustrative electrophotographic printing machines incorporating the features of the present invention therein. As shown, the drawings schematically depict the various components of each of these electrophotographic printing machines which have the various features of the present invention incorporated therein. Inasmuch as the art of electrophotographic printing is well known, the various processing stations employed in the printing machines will be shown herein schematically and their operation described with reference thereto.

Referring now to FIG. 1, the embodiment of the electrophotographic printing machine depicted thereat includes a drum, indicated generally by the reference numeral 10, having a photoconductive surface secured to a conductive substrate. Drum 10 is mounted rotatably on a carriage (not shown) which translates in the direction of arrow 12. As drum 10 translates in the direction of arrow 12, it rotates about its longitudinal axis in the direction of arrow 14. In this way, the drum velocity at the point of exposure is essentially zero. Thus, the photoconductive surface, at the point of exposure to a light image of an original document has zero velocity.

At charging station A, a corona generating device, indicated generally by the reference numeral 16, translates with the drum so as to charge successive portions of the photoconductive surface of drum 10 to a relatively high, substantially uniform potential. Corona generating device 16 is mounted on the carriage supporting drum 10 rotatably so as to translate therewith.

Next the charged portion of the photoconductive surface of drum 10 is illuminated at exposure station B. The original document 18 is positioned face down upon a stationary transparent platen 20. The exposure system includes a lamp 22 and lens strip 24 mounted on the carriage supporting drum 10 so as to translate therewith. As lamp 22 translates, it illuminates incremental widths of original document 18. The light rays transmitted from the original document 18 are transmitted through lens strip 24 from a light image thereof. This light image selectively discharges the charged portion of the photoconductive surface of drum 10 so as to form an electrostatic latent image thereon. The instantaneous velocity of the photoconductive surface of drum 10 is zero at exposure station B. In operation, as lamp 22 and lens strip 24 translate relative to original document 18, successive charged portions of the photoconductive surface are positioned at exposure station B having a zero velocity relative to the stationary original document. This permits wide latitudes in system operations. A suitable lens strip optical system is described in U.S. Pat. No. 3,544,190 issued to Moorhausen in 1970, the relevant portions thereof being hereby incorporated into the present application.

Next, drum 10 rotates the electrostatic latent image recorded on the photoconductive surface thereof to transfer station C. At transfer station C, the electrostatic latent image recorded on the photoconductive surface of drum 10 is transferred to a dielectric sheet 26. A conveyor (not shown) translates the dielectric sheet in the direction of arrow 12 at twice the linear velocity of drum 10. During the translation of both drum 10 and dielectric sheet 26 in the direction of arrow 12, drum 10 continues to rotate in the direction of arrow 14 so as to transfer incremental electrostatic latent images onto dielectric sheet 26. When dielectric sheet 26 reaches the end of movement, i.e. one half a revolution of drum 10 beyond the end of platen 20, as shown by the dotted representation of drum 10, the entire electrostatic latent image has transferred thereto. The relative linear velocity between drum 10 and dielectric sheet 26 at the point of contact, is essentially zero. Preferably, dielectric sheet 26 may be of any composition suitable for electrographic recording. By way of example, Mylar, polystyrene and polyethylene are examples of coatings which may be formed on plain paper to produce a dielectric sheet capable of retaining an electrostatic latent image thereon.

At transfer station C, the electrostatic latent image is transferred from drum 10 to dielectric sheet 26. Inasmuch as the charge on dielectric sheet 26 is not dissipated by exposure to light, it is not necessary to shield the image from light during the subsequent processing steps. Dielectric sheet 26 contacts an elongated conductive rubber roller 28. A non-conductive rubber pad 30 is positioned prior to roller 28 in the direction of rotation of drum 10, as indicated by arrow 14. Both roller 28 and pad 30 are mounted on the translating carriage supporting drum 10 rotatably. Preferably, roller 28 is electrically grounded provided the photoconductive surface of drum 10 is maintained at a sufficiently high potential. Alternatively, if the photoconductive surface of drum 10 is at a lower potential, voltage source electrically couples roller 30 to the conductive backing of drum 10. The voltage source applies an electrical field between the conductive backing of drum 10 and roller 30. The electrical field applied by the voltage source is of a suitable magnitude and polarity to transfer the electrostatic latent image from the photoconductive surface of drum 10 to the dielectric sheet. Preferably, the potential difference between the conductive backing of drum 10 and conductive roller 28 is about 1,000 volts. Various techniques have hereinbefore been described teaching the process of transferring an electrostatic latent image from a photoconductive surface to a dielectric sheet. Typical techniques are described in U.S. Pat. No. 2,833,648 issued to Walkup in 1958, U.S. Pat. No. 2,937,943 issued to Walkup in 1960, U.S. Pat. No. 2,975,052 issued to Fotland et al, in 1961, U.S. Pat. No. 2,982,647 issued to Carlson in 1961, and U.S. Pat. No. 3,055,006 issued to Dreyfoos et al. in 1962. The relevant portions of the foregoing patents are hereby incorporated into the present application.

Preferably, the carriage supporting drum 10 and the various processing stations translating therewith is mounted on a drive screw and bearing rod arranged with their axes in a parallel and spaced relationship on a base plate. A motor, coupled to a gear box, turns the drive screw which in turn translates the carriage in the direction of arrow 12.

After the electrostatic latent image is transferred to the dielectric sheet, a conveyor (not shown) advances the dielectric sheet to development station D. Development station D is positioned after platen 20. Hence, electrostatic transfer is terminated when drum 10 reaches the end of its travel, i.e. one half a revolution of drum 10 beyond the end of platen 20. Development station D includes a magnetic brush development system, indicated generally by the reference numeral 32. The magnetic brush development system advances magnetic particles into contact with the electrostatic latent image on dielectric sheet 26. A hopper 34 stores a supply of magnetic particles 36 therein. Magnetic particles 36 are dispensed from hopper 34 onto tubular member 38. Preferably, tubular member 38 is made from a non-magnetic material, such as aluminum. An elongated magnetic member 40 is mounted rotatably interiorly of tubular member 38. Tubular member 38 is stationary and as magnetic member 40 rotates, magnetic particles 36 are transported into contact with the electrostatic latent image formed on dielectric sheet 26.

After the electrostatic latent image formed on dielectric sheet 26 has been developed with magnetic particles, a conveyor (not shown) advances dielectric sheet 26 to fusing station E having a fusing system indicated generally by the reference numeral 42. An exemplary fusing system 42 is a cold roll pressure system including a pair of rollers 44 and 46. The dielectric sheet with the powder image thereon passes between rollers 44 and 46. Rollers 44 and 46 apply pressure on the powder image to permanently affix it to the dielectric sheet. Preferably, rollers 44 and 46 are made from chrome plated as stainless steel. Rollers 44 and 46 rotate in a suitable direction so as to continue to advance dielectric sheet 26. After fusing, dielectric sheet 26 advances to the catch tray (not shown). When the sheet is in the catch tray, it may be subsequently removed therefrom by the machine operator.

Figure 2:
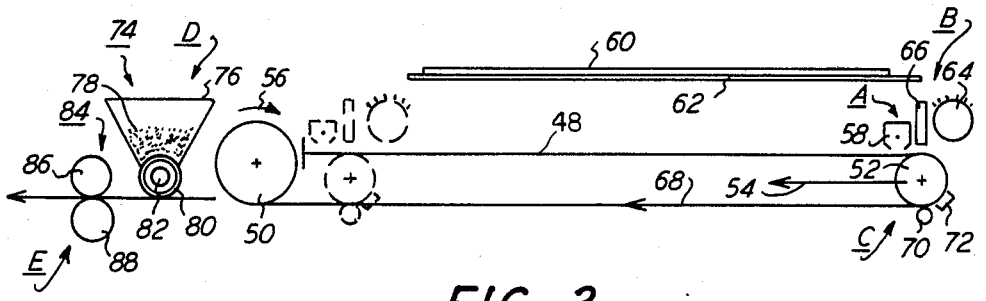
FIG. 2 shows a schematic elevational view of another embodiment of the reproducing machine of the present invention using a photoconductive belt.

The process heretofore described is only one embodiment of the reproducing machine of the present invention. Turning now to FIG. 2, there is shown still another embodiment thereof. As shown in FIG. 2, photoconductive web or belt 48 has one end thereof secured to the frame of the printing machine with the other end thereof wound about a take-up spool 50. Belt 48 is entrained about roller 52 which is mounted on a movable carriage (not shown) so as to translate in the direction of arrow 54. The carriage may be driven in the manner heretofore described with reference to the embodiment of FIG. 1 or by any other suitable means. As roller 52 translates in the direction of arrow 54, take-up spool 50 rotates in the direction of arrow 56 so as to take-up belt 48 as roller 52 translates in the direction of arrow 54. Once again both the photoconductive belt and original document are stationary at the point of exposure. Initially, charging station A passes over successive segments of the photoconductive belt. Charging station A includes a corona generating device, indicated generally by the reference numeral 58, which charges the photoconductive surface of belt 48 to a relatively high substantially uniform potential. Corona generator 58 is mounted on the carriage translating roller 52 so as to move therewith to continuously charge segments of belt 48.

Thereafter, exposure station B passes over the charged portions of belt 48. At exposure station B, an original document 60 is positioned face-down on a stationary transparent platen 62. Exposure station B includes lamps 64 and lens strip 66 mounted on the carriage supporting roller 52. Hence, as lamp 64 advances in the direction of arrow 54, it illuminates incremental width strips of original document 60. The light rays transmitted from these incremental width strips pass through lens strip 66 to form a light image thereof which is projected onto successive charged portions of photoconductive belt 48. This forms an electrostatic latent image corresponding to the original document being illuminated.

Next, as roller 52 translates in the direction of arrow 54, the electrostatic latent image recorded belt 48 pass through transfer station C. At transfer station C, the electrostatic latent image recorded on belt 48 is transferred to a dielectric sheet 68. The dielectric sheet advances at twice the linear velocity of roller 52. In this way, the relative linear velocity between the photoconductive surface of belt 48 and the dielectric sheet, at the point of contact, is zero. Dielectric sheet 68 passes between conductive rubber roller 70 and photoconductive belt 48. Preferably, roller 70 is electrically grounded. Alternatively, a voltage source may be connected between electrode 70 and the conductive backing of belt 48. The voltage source applies an electrical field between the conductive backing and electrode 70. The electrical field supplied by the voltage source is of a suitable magnitude and polarity to transfer the electrostatic latent image from the photoconductive surface of belt 48 to the dielectric sheet. A non-conductive rubber pad 72 is disposed prior to roller 70. Roller 70 and pad 72 are also secured to the carriage supporting roller 52 so as to translate therewith. Alternatively, roller 70 and pad 72 may be mounted stationarily, at any point along the path of movement of roller 52. Preferably, in this configuration, roller 70 and pad 72 are located just prior to take-up roller 50, i.e. just prior to the lead edge of the electrostatic latent image recorded on the photoconductive surface of belt 48 being entrained thereabout. This enables the dielectric sheet feeder to be positioned beneath belt 48 reducing the overall size of the printing machine. After the electrostatic latent image is transferred to the dielectric sheet, the dielectric sheet advances to development station D.

At development station D, a magnetic brush development system, indicated generally by the reference numeral 74, advances magnetic particles into contact with the electrostatic latent image formed on the dielectric sheet. Preferably, the developer material, i.e. the magnetic particles, is a single component development material. Magnetic brush development system 74 includes a hopper 76 for holding a supply of magnetic particles 78 therein. The magnetic particles are dispensed from the hopper onto stationary tubular member 80. Preferably, tubular member 80 is made from a nonmagnetic material such as aluminum. An elongated magnetic member 82 is mounted rotatably interiorly of tubular member 80. In this manner, a magnetic field is created which attracts the magnetic particles to tubular member 80. As magnetic member 82 rotates, the magnetic particles are transported into contact with the electrostatic latent image formed on the dielectric sheet.

After the electrostatic latent image formed on the dielectric sheet has been developed with magnetic particles, the dielectric sheet is advanced to fusing station E. Fusing station E, indicated generally by the reference numeral 84, includes a pair of rollers 86 and 88. The dielectric sheet with the powder image thereon passes between rollers 86 and 88. The rollers are preferably made from chrome plated stainless steel or any other material which can apply sufficient pressure to permanently affix the powder image to the dielectric sheet.

After fusing, a conveyor (not shown) advances the dielectric sheet with the powder image permanently affixed thereto to a catch tray (not shown). In the catch tray, the dielectric sheet, i.e. the finished copy sheet, may be readily removed therefrom by the machine operator.

Figure 3:
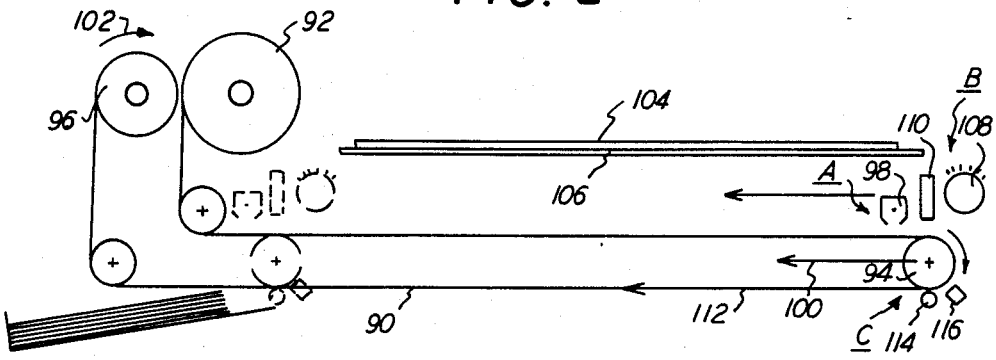
FIG. 3 depicts a schematic elevational view of still another embodiment of the reproducing machine of the present invention using a photoconductive belt.

Referring now to FIG. 3, there is shown still another embodiment of the reproducing machine of the present invention. The embodiment depicted in FIG. 3 also employs a photoconductive belt. As shown thereat, belt 90 advances from a supply spool 92 about roller 94 onto a take-up spool 96. Roller 94 is mounted on a carriage so as to translate in the direction of arrow 100. As roller 94 translates in the direction of arrow 100, take-up spool 96 rotates so as to take up any slack in the photoconductive belt. However, when roller 94 returns to its initial position, the same initial segment of the photoconductive belt is disposed beneath the platen supporting the original document. Hence, the same segment of the photoconductive belt is continually reused to produce a multiplicity of copies. After many thousands of copies have been made, this segment of the photoconductive belt may become fatigued. In order to obviate this problem, supply spool 92 operating in conjunction with take-up spool 96 will advance a new segment of photoreceptor material which, in turn, is also entrained about roller 94. With roller 94 fixed in the initial position, take-up spool 96 rotates to advance a new section of the photoconductive belt 90 from supply spool 92 into its operative position. Once again, photoconductive belt 90 and the original document are stationary during the exposure process.

Initially, charging station A passes over successive portions of photoconductive belt 90. At charging station A, a corona generating device, indicated generally by the reference numeral 98, charges the successive portions of the photoconductive surface of belt 90 to a relatively high, substantially uniform potential. Corona generating device 98 is mounted on the carriage supporting roller 94 so as to translate therewith.

At exposure station B, an original document 104 is positioned on a stationary transparent platen 106. The exposure station includes lamps 108 and lens strip 110 secured to the carriage translating idler roller 94. As lamp 108 translates in the direction of arrow 100, it illuminates incremental widths of original document 104. The incremental width light rays transmitted from document 104 pass through lens strip 110 so as to form an incremental width light image thereof. These light images, in turn, are projected onto successive charged portions of photoconductive belt 90 so as to selectively discharge these portions. This records an electrostatic latent image on photoconductive belt 90.

Next, electrostatic latent image recorded on photoconductive belt 90 is transferred to dielectric sheet 112 at transfer station C. Dielectric sheet advances in the direction of arrow 100 at twice the linear velocity of roller 94. In this manner, the relative linear velocity between roller 94 and dielectric sheet 112 is moving at zero velocity at the point of contact. Dielectric sheet 112 passes between photoconductive belt 90 and a conductive rubber roller 114. Preferably roller 114 is electrically grounded. However, in the alternative, a voltage source may be connected between roller 114 and the conductive backing of photoconductive belt 90. The electrical field applied by the voltage source is of a suitable magnitude and polarity to transfer the electrostatic latent image from the photoconductive surface of belt 90 to the dielectric sheet. A non-conductive rubber pad 116 is positioned prior to roller 114. After roller 94 has translated one half a revolution beyond the end of stationary platen 106, the entire electrostatic latent image is effectively transferred to dielectric sheet 112. At this point, the dielectric sheet moves through the development station and fusing stations previously discussed with regard to FIG. 2. The dielectric sheet, with the powder image permanently affixed thereto, is then advanced to a catch tray for subsequent removal from the printing machine by the operator.

One skilled in the art will appreciate that many other techniques may be employed in conjunction with the embodiment shown in FIG. 3. For example, the photoconductive member itself may be the copy sheet with successive portions thereof being cut to size after development and fusing rather than being advanced about the take-up spool. Alternatively, the image portions of the photoconductive member may be transferred directly to a copy sheet forming a visible image of the original document. In these latter configurations, each portion of the photoconductive member is used over rather several thousand times prior to being replenished.

In recapitulation, it is evident that the reproducing machine of the present invention employs a stationary photoconductive member and a stationary original document. A dielectric sheet moves into contact with the photoconductive member so that the electrostatic latent image recorded thereon may be transferred thereto. The processing stations associated with the photoconductive member translate relative thereto. A system of this type readily lends itself for usage in desk type low cost reproducing machines.

It is, therefore, evident that there has been provided in accordance with the present invention a reproducing machine that fully satisfies the aims and advantages hereinbefore set forth. While this invention has been described in conjunction with the various specific embodiments thereof, it will be evident that many alternatives, modifications and variations will be apparent to those skilled in the art. Accordingly, it is intended to embrace all such alternatives, modifications and variations that fall within the spirit and broad scope of the appended claims.

What is claimed is:

1. An improved electrophotographic reproducing machine of the type having a fixed platen for stationarily supporting an original document to be reproduced, a photoconductive belt having a photoconductive surface on one side thereof, means for charging the photoconductive belt surface with an uniform charge, means for incrementally scanning the original document on the fixed platen one segment at a time and concurrently exposing the uniformly charged photoconductive belt surface to the scanned image segments to record an electrostatic latent image of the original document on said photoconductive belt surface one segment at a time, and means for transferring the electrostatic latent image to a dielectric copy sheet, wherein the improvement comprises:

a translatable carriage having fixedly mounted thereon in fixed relationship to each other the charging means, the scanning and exposing means, the transfer means, and a roller about which the photoconductive belt is entrained, the roller having an axis parallel to the fixed platen;

means to translate the carriage in a direction parallel to the fixed platen and perpendicular to the roller axis to effect the incremental scanning of the original document and concurrent recording thereof on the photoconductive belt surface and in the opposite direction to return the carriage for scanning the same document again or a subsequent document placed on the fixed platen; and the photoconductive belt having two ends and being entrained about the carriage roller at a location intermediate the ends, means for holding one end of the photoconductive belt stationary at least during the recording of the electrostatic latent image thereon, the other end of the photoconductive belt being attached to a fixedly positioned take-up roll adapted to take up the slack of the photoconductive belt and keep it taut about the carriage roller as the carriage moves in a scanning direction or to dispense the photoconductive belt as the carriage moves in the opposite direction to return the carriage for subsequet document scanning, the photoconductive belt surface confronting the fixed platen and being held stationarily parallel thereto prior to and during the recording thereon of the electrostatic latent image segments, whereupon the carriage translating means moves the carriage, so that the portion of the photoconductive belt surface having the recorded latent image segments travels around the carriage roller towards the transfer means and take-up roller, while the unrecorded portion of the photoconductive belt is held stationary.

2. The improved reproducing machine of claim 1, wherein the charging means is located upstream of the scanning and exposing means to charge the belt photoconductive belt surface prior to the recording thereon of the electrostatic latent image segments.

3. The improved reproducing machine of claim 2, wherein the scanning and exposing means is a lamp and a lens strip combination mounted on said carriage in fixed relationship to each other and the carriage roller.

4. The improved reproducing machine of claim 3, wherein the improvement further comprises:

means for moving seriatim dielectric copy sheets into lineal contact with the photoconductive belt on the carriage roller and at the location of the transfer means, the copy sheets each moving in the same direction as the translating carriage, one copy sheet being moved for each original document scanned, the moving velocity of the copy sheet being twice that of the linear velocity of the carriage roller, so that the relative velocity between the photoconductive surface of the belt and the copy sheet at the point of contact is zero enabling the electrostatic latent image segments to be transferred to the copy sheets incrementally by the transfer means, whereby after the electrostatic latent image has been transferred to the copy sheet, it does not have to be shielded from light;

means for advancing the copy sheet with the electrostatic latent image to a development station, whereat the electrostatic latent image is developed with development particles; and means for conveying the copy sheets with the developed images to a fixing station, whereat the developed image are permanently fixed to said copy sheet.

5. The improved reproducing machine of claim 3, wherein the means for holding one end of the photoconductive belt stationary comprises securing one end of the photoconductive belt to a stationary frame member of the reproducing machine.

6. The improved reproducing machine of claim 3, wherein the means for holding one end of the photoconductive belt sationary comprises a supply spool from which a length of photoconductive belt is periodically dispensed to replace a damaged or worn belt length, and between periodic dispensing of photoconductive belt lengths, the supply spool fixedly secures one end of the photoconductive belt.

* * * * *